United States Patent [19]

Pollack

[11] Patent Number: 4,637,335

[45] Date of Patent: Jan. 20, 1987

[54] OFFSHORE HYDROCARBON PRODUCTION SYSTEM

[75] Inventor: Jack Pollack, Reseda, Calif.

[73] Assignee: Amtel, Inc., Providence, R.I.

[21] Appl. No.: 603,434

[22] Filed: Apr. 24, 1984

Related U.S. Application Data

[63] Continuation-in-part of Ser. No. 438,322, Nov. 1, 1982.

[51] Int. Cl.[4] ..... B63B 21/52

[52] U.S. Cl. ..... 114/230; 441/4

[58] Field of Search ..... 441/3–5; 114/230; 166/350–357; 405/202, 224, 188; 141/279, 382, 387, 384, 284, 280

[56] References Cited

U.S. PATENT DOCUMENTS

| | | | |
|---|---|---|---|
| Re. 26,668 | 9/1969 | Word, Jr. et al. | 166/352 |
| 2,666,934 | 1/1954 | Leifheit | 114/230 |
| 3,557,396 | 1/1971 | Rupp | 441/5 |
| 3,638,720 | 2/1972 | Thomas | 166/357 |
| 3,834,432 | 9/1974 | Lilly, Jr. et al. | 141/279 |
| 4,146,345 | 3/1979 | Silvestri | 405/188 |
| 4,262,380 | 4/1981 | Foolen | 441/3 |
| 4,281,614 | 8/1981 | McNary et al. | 441/4 |
| 4,478,586 | 10/1984 | Gentry et al. | 441/4 |
| 4,490,121 | 12/1984 | Coppens et al. | 441/5 |

*Primary Examiner*—Sherman D. Basinger
*Assistant Examiner*—Edwin L. Swinehart
*Attorney, Agent, or Firm*—Freilich, Hornbaker, Rosen & Fernandez

[57] ABSTRACT

An offshore hydrocarbon production system is provided, which is of relatively low cost. The system includes a vessel (12) having a platform (24) that allows the vessel to rotate about a vertical axis with respect to the platform, and a column (14) having an upper end pivotally connected to the platform about horizontal axes (32, 34) and a lower end anchored solely by a group of loose chains (38) that permit the lower column end to tilt and move in every direction. The lower end of the column is weighted by a counterweight and by the chains, so the column acts like a pendulum that tends to return to the vertical when tilted, to urge a drifting vessel back towards its quiescent position. The bottom of the column also moves laterally during such vessel drifting, increasing tension in one chain (38*a*) and reducing tension in an opposite chain (38*b*) to also urge the vessel back towards its quiescent position. The column can be sunk with the vessel sailing away, and its reconnection to the vessel is facilitated by the provision of a two-axes joint at the bottom of the platform.

7 Claims, 7 Drawing Figures

OFFSHORE HYDROCARBON PRODUCTION SYSTEM

CROSS REFERENCE TO RELATED APPLICATION

This is a continuation-in-part of U.S. patent application Ser. No. 438,322 filed Nov. 1, 1982, now abandoned.

BACKGROUND OF THE INVENTION

One type of single point mooring system includes a transfer structure whose lower end is anchored to the sea floor to limit lateral drifting and rotation about a vertical axis. The upper end of the transfer structure is supported by a vessel by a joint that permits the vessel to rotate 360° about the transfer structure. A transfer structure in the form of a column which extends along much of the height of the sea is desireable in many cases, because it permits a protected oil-carrying hard pipe to extend most of the height of the sea. One type of column has a lower end pivotally mounted by a 2-axis joint to a base at the sea floor. Such mounting is expensive. Another type, shown in U.S. Pat. No. 4,262,620 by Nooteboom uses a pair of chains instead of a column, and anchors the bottom of the chain-column with a largely horizontally-extending arm whose lower end is held in a pivot joint to the sea floor. Such mounting is also expensive, and produces uneven mooring forces in different drift directions. A column mooring system which enabled low cost mooring of the column while enabling the obtaining of uniform mooring forces in every direction of vessel drift and applying mooring forces that increase gently with progressively increasing vessel drift up to a large force during large vessel drifting, would be of great value.

The mooring and cargo-transfer structures which employ a floating vessel, have generally been useful for transferring cleaned hydrocarbons to a ship, but not generally for the production of hydrocarbons from undersea wells. In the production of hydrocarbons from undersea wells, the well effluent typically includes solid and fluid impurities including sand and water, as well as liquid and gas. Furthermore, a well typically produces at high pressures such as 6,000 psi. Reliable fluid swivels for permitting the vessel to drift 360° about the transfer structure, have not been available to transfer fluids at such high pressures. Any sand or other particles present in the fluids would add to maintenance problems of any such swivel. Research has been conducted on the design of such fluid swivels, but it would appear that the cost and maintenance of the swivel could be prohibitive. Accordingly, undersea hydrocarbons are typically produced using large and expensive fixed platforms. An offshore terminal that permitted the production of hydrocarbons from undersea wells, by the use of floating vessels, would permit the production of undersea hydrocarbons at lower cost.

SUMMARY OF THE INVENTION

In accordance with one embodiment of the present invention, a mooring and cargo transfer terminal is provided, of the type which includes a column extending much of the distance between a floating vessel and the sea floor, which has superior capabilities. The column has an upper end mounted to the vessel to enable pivoting about a pair of horizontal axes, and a lower end anchored solely by a group of flexible lines such as chains, to the sea floor. For any direction of vessel drift, the column tilts and its lower end is lifted in a pendulum-like action. The horizontal component of the "pendulum", formed by the column hanging at an angle from the vessel, urges the vessel back towards its quiescent position. The pendulum action also tightens a group of chains, to thereby apply large mooring forces over a considerable distance of vessel drift, in a smooth gradually-increasing manner.

The terminal can be used as a hydrocarbon production terminal wherein hydrocarbons are produced from an undersea well at high pressures, and wherein the hydrocarbons may have solid impurities such as sand. This can be accomplished by the use of a rotatably-mounted platform on the vessel that can rotate about a vertical axis with respect to the hull of the vessel. The platform includes means for reducing the pressure of the well effluent, such as from 6,000 psi to 1,000 psi, and can also include apparatus for removing particles and gas and for reinjecting the gas at high pressures. As a result, it is possible to use a fluid swivel to permit the vessel to rotate continuously about the platform while transferring fluid between them, at only moderate pressures and with only a reduced level of particulate contaminants.

The column can be disconnected from the vessel so the vessel can sail away, and can be later reconnected. Reconnection even under moderately adverse weather conditions is facilitated by the provision of a two axis joint at the bottom of the rotatably-mounted platform. Reconnection is also facilitated by the use of cable guides on the two-axis joint.

The novel features of the invention are set forth with particularity in the appended claims. The invention will be best understood from the following description when read in conjunction with the accompanying drawings.

DESCRIPTION OF THE PREFERRED EMBODIMENTS

Figures 1, 3:
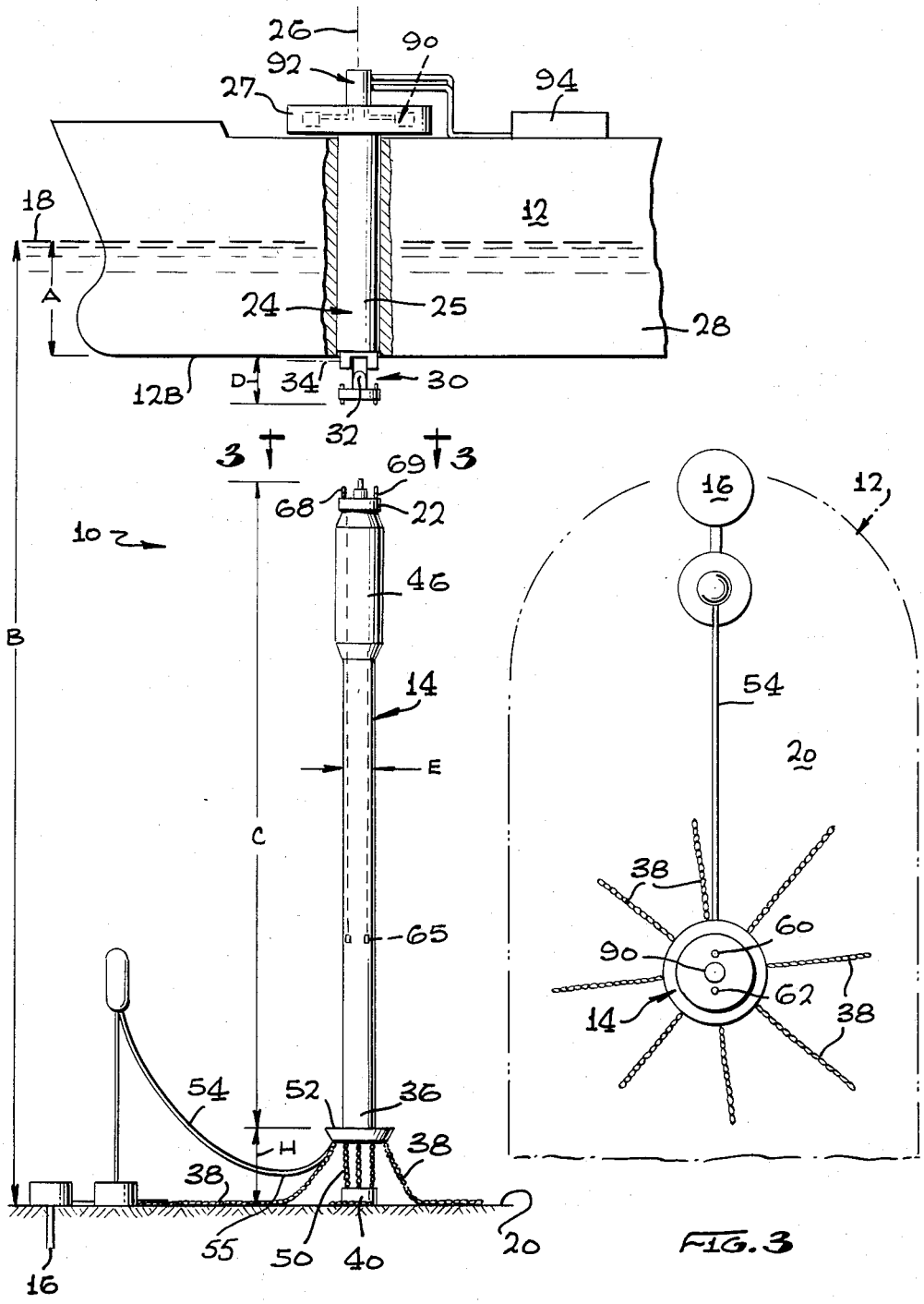
FIG. 1 is a side elevation view of a terminal constructed in accordance with one embodiment of the present invention, shown with the column in a disconnected stored position.
FIG. 3 is a view taken on the line 3—3 of FIG. 1.

FIG. 1 illustrates an offshore mooring and cargo-transfer terminal 10 which includes a vessel 12 for processing and storing hydrocarbons (primarily liquids) until they can be transferred to a tanker (not shown). The system also includes a column-type transfer structure 14 for mooring the vessel and carrying the hydrocarbons from undersea wells 16 up to the vessel. The column 14 extends along much of the height of the sea between the bottom 12B of the vessel and the sea floor 20. It can be seen in FIG. 1 that the column extends by at least about half the height of the sea. The column is shown in a disconnected stored position in FIG. 1, but it can be raised to the deployed position shown in FIG. 2, wherein its upper end 22 is connected to a rotatably-mounted platform 24 on the vessel. The platform, which includes a turret 25 within the vessel hull and a wider turntable 27 above the hull, can rotate about a vertical axis 26 without limit with respect to the hull 28 of the vessel. A "universal" joint 30 at the bottom of the turret permits the column to pivot about two horizontal axes 32,34 with respect to the platform 24. The lower end 36 of the column is anchored by a group of flexible lines in the form of chains 38 that extend in different compass directions from the bottom of the column and in loose catenary curves to the sea floor where they are anchored as at 40'.

Figure 2:
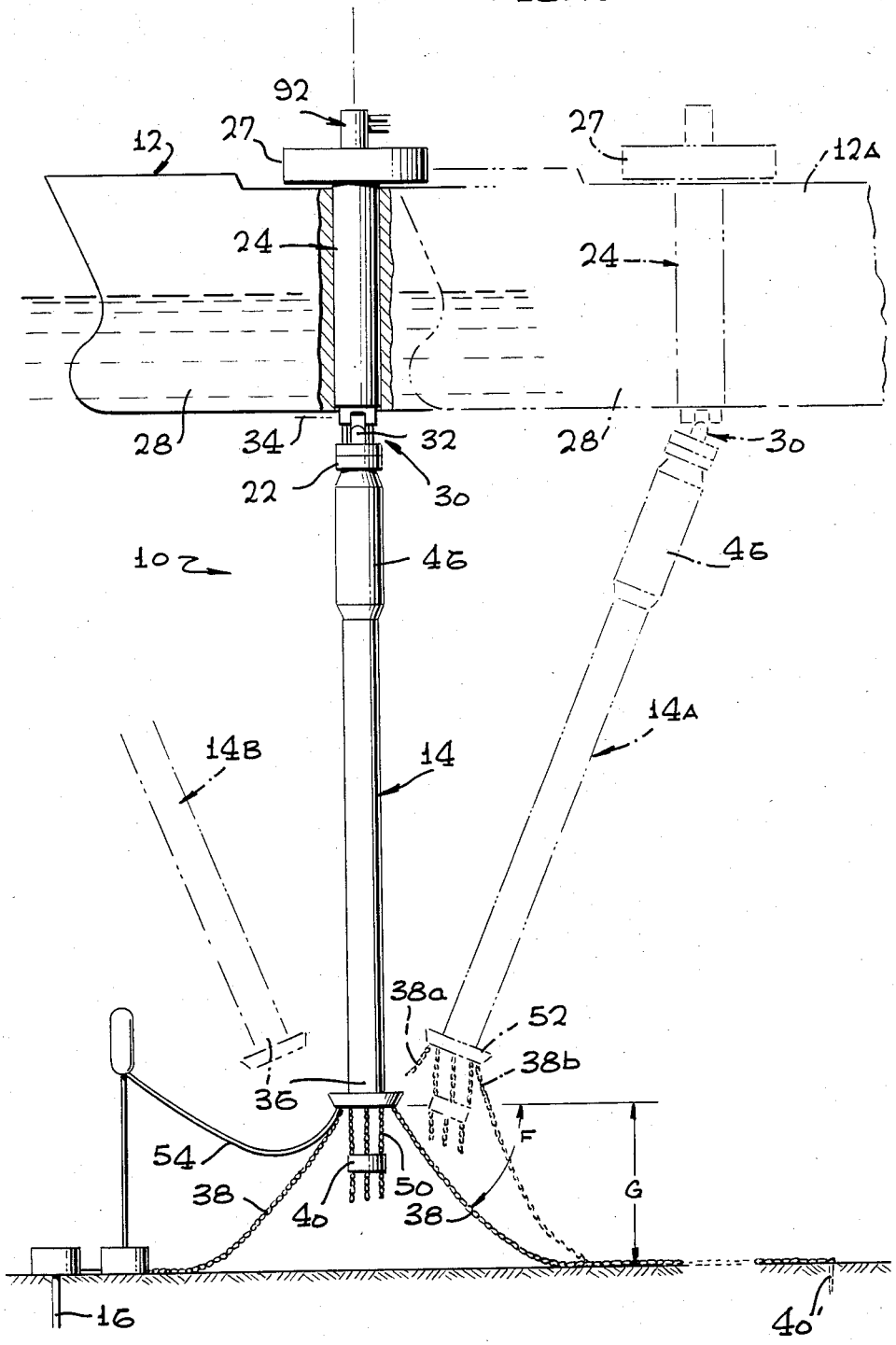
FIG. 2 is a view similar to FIG. 1, but with the column in a connected position.

When the vessel 12 drifts from its quiescent position shown in solid lines in FIG. 2, in any direction such as to the position 12A, the column 14 tilts and also undergoes a horizontal displacement, as to the position shown at 14A. One factor which urges the vessel back towards its quiescent position, is a "pendulum" effect, wherein the column at 14A acts like a pendulum whose lower end has been raised from a position directly under its pivot axis. To create this effect, the lower end 36 (within the lowest 10% of the total column height C) of the column is heavily weighted, this being accomplished by the considerable weight of the chains 38 and the additional weight of a clump weight 40 which is attached to the lower end of the column. Another factor is the horizontal displacement of the lower end 36 of the column, which results in one chain **38*a* being raised so it is under greater tension and the tension is directed along a more horizontal direction, and with the opposite chain 38*b* being looser and with its weight directed downwardly rather than with a large sideward component. The use of only chains to anchor the lower end of the column, results in the uniform gradual application of mooring forces to a drifting vessel, regardless of the orientation to which winds, waves, and currents have rotated the vessel. That is, the same gradual application of large mooring forces will occur even if the column is pulled to the opposite side as to the position shown at 14B**.

The top of the column is detachable from the vessel. This is especially useful for northern latitudes where ice may be encountered that could damage a ship floating at the surface but which would not harm a column who's upper end is located at least a few meters below the sea surface. The column includes a buoy 46 at its upper end which serves to prevent the column from falling over when detached from the vessel, and which has sufficient buoyancy to support the entire weight of the column and at least some of the weight of the chains 38. The clump weight 40 is hung by a group of hanging chains 50 from the bottom of the chain table 52 at the bottom of the column. When the column is released, it falls until the clump weight 40 rests on the sea floor. The buoyancy of the column is not sufficient to support all of the weight of the clump weight 40, but supports some of its weight, so the column then stops moving downwardly. This weight therefore closely fixes the depth H to which the column will sink. It is important that the bottom of the column not fall on the sea floor, or else a flexible conduit 54 which carries hydrocarbons to the column and which extends in loop 55, could drag on the sea floor and become damaged, and the bottom of the column itself could become damaged.

Figure 4:
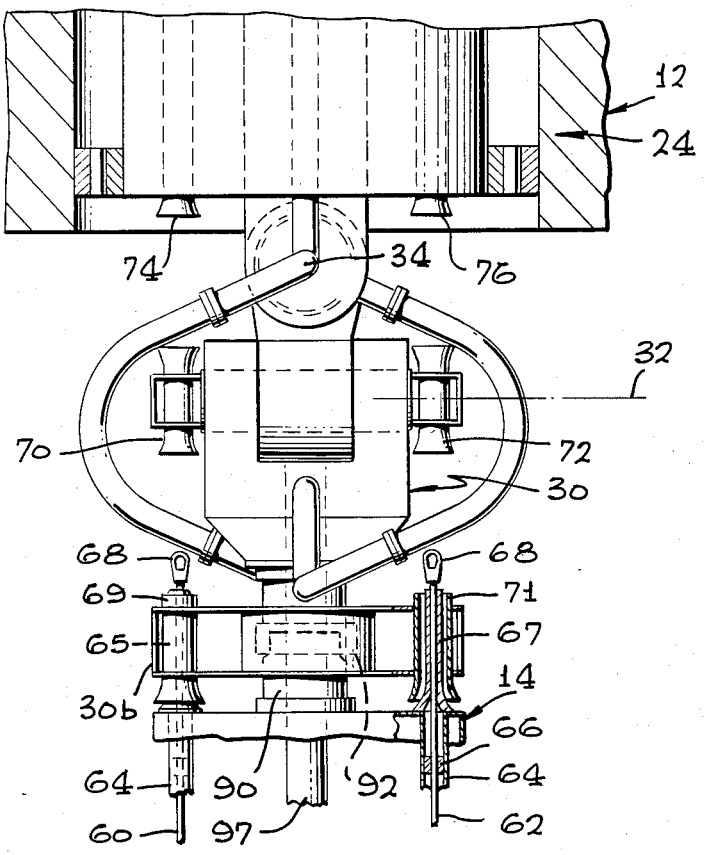
FIG. 4 is a view of a portion of the terminal of FIG. 2.

The system is constructed to facilitate the reconnection of a sunk column, normally without the aid of divers. As shown in FIG. 4, the column includes a pair of riser installation cables 60, 62 which can slide freely within cable tubes 64 in the column until a stop (65, FIG. 1) at the bottom of each cable encounters a stop 66 near the top of the tube. When a vessel 12 (FIG. 1) approaches a sunk column, it can pick up the padeyes 68 at the top of the cables by any of a variety of known methods, including the pickup of floating messenger lines whose lower ends are attached to the padeyes 68, or by use of a recovery vehicle sent from the vessel to pick up the upper ends of the riser cables. The cables 60, 62 (FIG. 4) are then drawn up through guide cones 65, 67 on the top of the column, lower cable guides 69, 71 at the bottom of the two axis joint 30, middle cable guides 70, 72 at the middle of the two axis joint, and then through platform cable guides 74, 76 that are mounted at the bottom of the rotating platform. It can be seen that each of the guides such as 71 has lower portion which has a width that increases at progressively lower locations.

Figure 5:
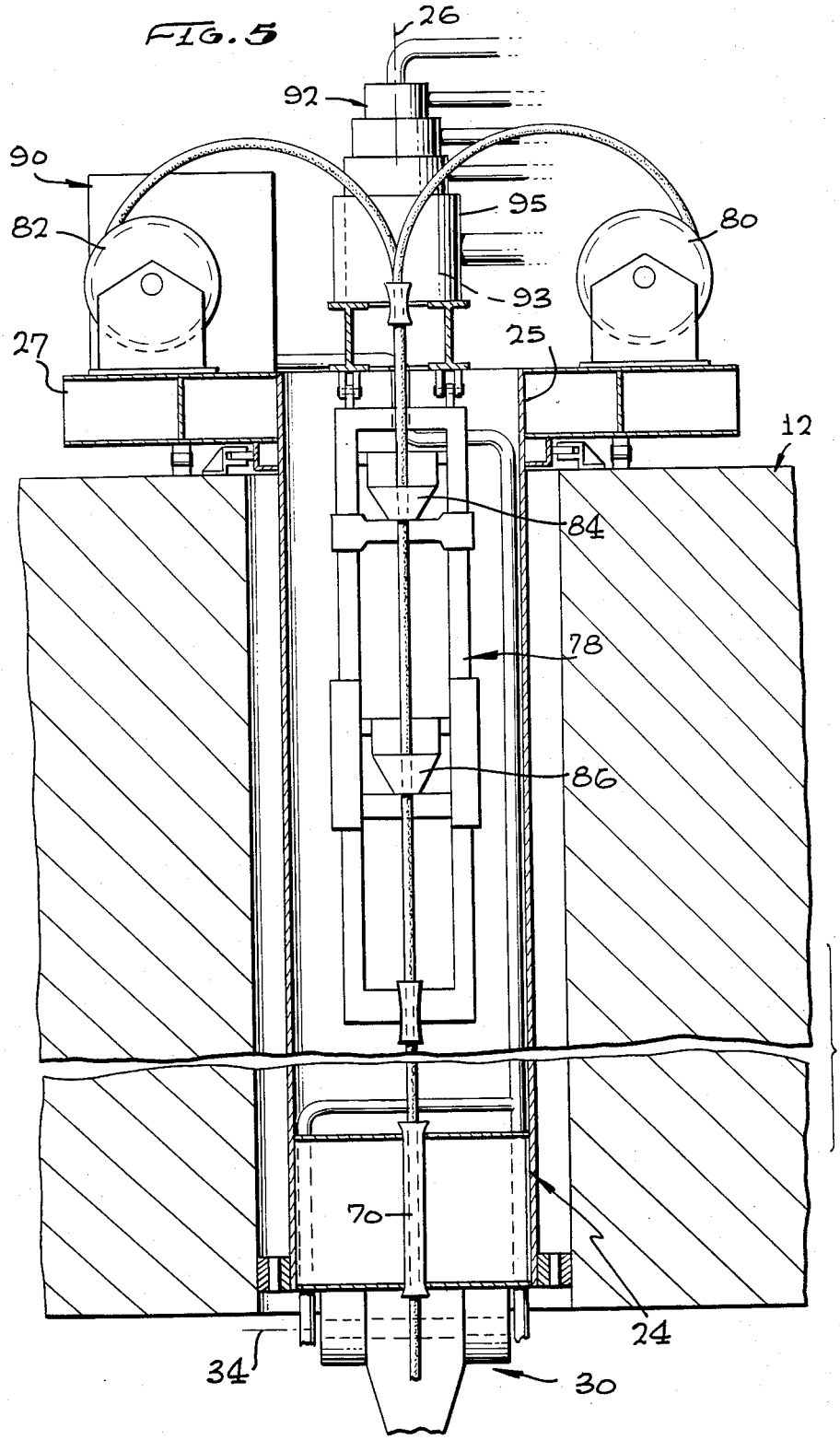
FIG. 5 is an elevation view of a portion of the apparatus of FIG. 2.

As shown in FIG. 5, each cable is drawn up through a linear winch 78 in the turret 25 and wound onto storage reels 80, 82 on the turntable 27 of the rotatablymounted platform. As the linear winch 78 operates, the upper grip 84 holds the cable as the lower grip 86 moves down, and the lower grip 86 holds the cable as it moves up. The column 14 is pulled up to the vessel until the column guide cones 65, 67 (FIG. 4) enter the cable guides 69, 71 at the bottom of the universal joint 30. This aligns the bottom **30*b* of the joint with the column, so a connector mandrel 90 (FIG. 4) at the top of the column can engage a locking dog 92 at the bottom of the two axes joint 30. After the connection is made, the installation cables 60, 62** are lowered back into the column.

The fact that the riser cables 60, 62 pass through the lower cable guides 69, 71 and the other cable guides 70, 72 and 74, 76, results in the bottom of the joint 30 becoming aligned with the top of the column 14, both in lateral position and angular orientation. This permits automatic connection of the column to the joint, particularly for the fluid couplings within the connector mandrel 90. All of this can be accomplished without the need for divers to assist in the connection. Furthermore, this automatic alignment permits the connection of the ship to the sunk column in moderately inclement weather, to avoid the need to wait until the seas are very calm before making the connection. The fact that the top of the column 14 lies a plurality of meters below the sea surface, even when it is fully raised, results in minimum reaction to waves and the resulting movement that would hamper connection.

The above arrangement is also useful in enabling rapid disconnection of the vessel from the column, while still assuring controlled sinking of the column. The hydraulic connector 92 can be activated at any time, causing the weight of the column to pull out of the connector. The suspended counterweight will sink to the sea floor, and the column will sink to slightly below the stored portion and then rise to it. It is possible to controllably sink the column by reverse operation of the linear winch, (after first raising the installation cables) to prevent the column from sinking substantially below its stored position.

The turntable 27 (FIG. 5) is a large rotatable structure which carries processing equipment 90 for processing effluent from undersea wells, before passing processed fluids through a fluid swivel 92 to storage equipment 94 on the vessel. The fluid swivel has a nonrotatable part 93 connected to the processing equipment 90 on the turret, and a rotatable part 95 connected to the storage equipment on the vessel. The effluent from undersea wells may be under high pressure such as 6000 psi and may include particulates such as sand. Available fluid swivels such as 92, for permitting rotation of the vessel about a vertical axis without limit while the platform 24 does not rotate, are not available to handle such high pressures or the possible contaminants in hydrocarbons as they are emitted from an undersea well. The high pressure cannot be simply reduced by a choke, because such a large pressure-reduction choke could emit large quantities of gas (because of volatile liquids turning into gas when the pressure is reduced). The resulting high velocity flows containing primarily gas and only a small proportion of liquids (which are often the desired hydrocarbon), could result in rapid wear of piping and small production of liquids. Previously, undersea production has been accomplished almost solely by the use of massive fixed platforms, which have legs that rest on the sea floor and which are very expensive, especially if they must withstand large forces, such as those applied by ice. The large cost of such fixed platforms and the long time required for their construction and installation, has hampered the production of hydrocarbons from smaller underwater reservoirs and has delayed initial production from larger fields.

Figure 6:
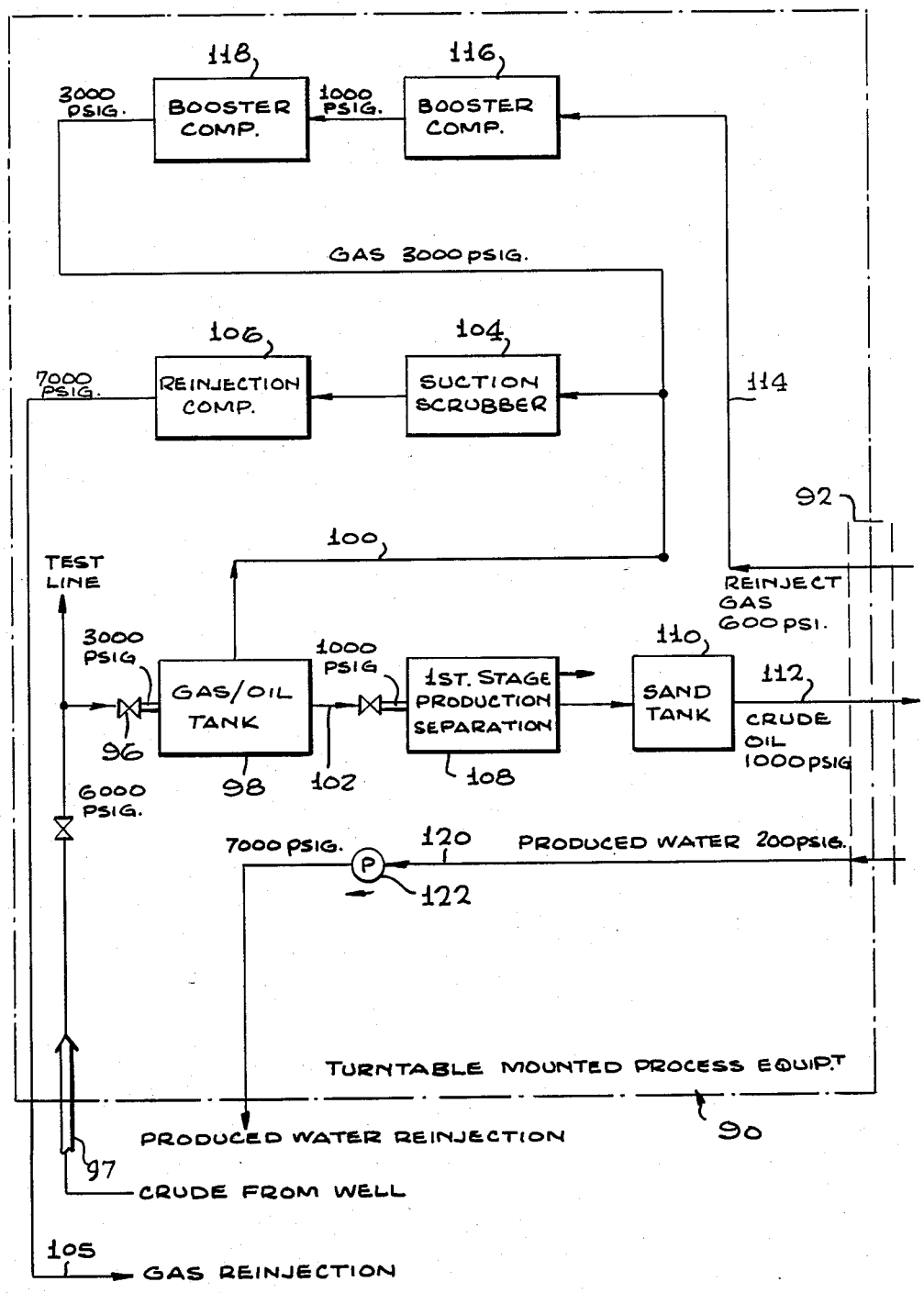
FIG. 6 is a simplified schematic diagram of the processing system of the apparatus of FIG. 2.

In accordance with the present invention, production equipment is mounted on the rotatably-mounted turntable on the vessel about which the rest of the vessel hull can rotate. FIG. 6 is a simplified view of the processing equipment 90 which is mounted on the turret. The equipment includes moderate size chokes 96 for reducing the initial well pressure in conduit 97, such as 6000 psi, to about half that amount. The high volatility liquids turn into gas, but a short length, large diameter and highly wear resistant conduit can be used at 97 or the outlet side of the choke can open directly to a large separation tank. The effluent enters a tank 98 which separates gas from liquid, and which has outlets 100, 102 that respectively carry primarily gas and liquid at the pressures present there. The gas passes through a scrubber 104 and a reinjection compressor 106 which compresses the gas to a pressure such as 7000 psi for reinjecting the highly volatile fractions through conduit 105 into the undersea well to help maintain the well pressure and therefore the production rate. The separated-out liquid in the outlet 102 passes through a choke and a separation device 108 which further separates the resulting gas from liquid, and which passes the liquid to a sand tank 110 which removes most of the sand and other particles in the well effluent. An outlet 112 of the tank carries crude oil, water, and gas in fluid form (moderately volatile hydrocarbons) which is now at 1000 psi and this is passed through the swivel unit 92 to process equipment on the stationary portion of the vessel.

The swivel unit 92 returns unused gas from the vessel deck processing equipment through a conduit 114 at a pressure such as 600 psi, whose pressure is boosted by a pair of compressors, 116, 118 and then delivered through the scrubber 104 to the reinjection compressor 106. An additional conduit 120 carries produced water (water with impurities) passing through the fluid swivel at a pressure such as 200 psi, to a pump 122 that increases the water pressure to 7000 psi right before it is reinjected into the subsea reservoir by way of injection wells.

The separation out of much of the highly volatile fluids produced from the well (in this application only the liquids are wanted) and their compression to slightly higher than well pressure, reduces the cost for reinjecting the gas. Reinjection cost is reduced by avoiding the need for large precompressors for most of the gas, the compressors 116, 118 being used only for a small amount of the gas. This plus the separation out of gas from liquid and subsequent reduction in liquid hydrocarbon pressure, the removal of much of the particles in the hydrocarbons, and the recompression of gas and water to high pressures, all on the platform which does not rotate with the vessel, enables an available fluid swivel 92 to be used in the production of hydrocarbons. The system still performs most, if not all, of the functions that are performed when a large stationary platform is used to produce hydrocarbons from undersea wells.

Figure 7:
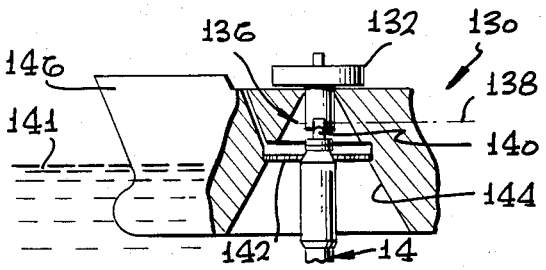
FIG. 7 is a partially sectional side view of a terminal constructed in accordance with another embodiment of the invention.

One of the areas of the installation where malfunctions are likely to occur, is at the two axis joint 30 (FIG. 4) and at the region where the joint connects to the top of the column 14. It would be desireable if technicians who are stationed on the vessel 12, could observe this region and perform maintenance and repairs thereon, without requiring such technicians to perform their work underwater. FIG. 7 illustrates another installation 130, which is largely similar to that of FIGS. 1–6, except that the platform 132 has a lower portion lying within the vessel hull, which extends by only a portion of the height of the hull, so that the two axis joints 136 which permits pivoting about two axes 138, 140, lies above the sea level 141, at least at a minimum ballast condition of the vessel (usually about 20% ballast). A viewing station 142 is provided within the vessel hull, which is accessible from the deck of the vessel, as opposed to requiring a technician to dive from the outside of the vessel, to enable a technician to view the area of the top of the column 14 and the two axis joint 136. The vessel has a wide recess 144 which is wider at its lower end (where it is at least twice as wide as the column there at) than at its top, to accomodate tilting of the column 14 relative to the vessel 146.

Thus, the invention provides an offshore mooring and cargo-transfer terminal that can also be used as a hydro-carbon terminal, which is of relatively low cost. The terminal includes a column which, in use, has an upper end pivotally mounted about a pair of horizontal axes to a rotatably-mounted platform on a vessel, and which has a lower end anchored to the sea floor. The lower end of the column is anchored solely by a group of flexible lines extending in loose catenary curves in different compass directions from the lower end of the column to locations on the sea floor where they are anchored to the sea floor. The lower end of the column is weighted, so that when it tilts it tends to act like a pendulum that rights itself. Thus, when the vessel drifts in any direction, the chains permit lateral movement of the bottom, but to a lesser degree than the top of the column, so the column is horizontally displaced and also tilted. The tendency of the column to pivot back towards the vertical, plus the lifting and tightening of one chain and the loosening of an opposite chain, results in a restoring force urging the vessel back towards its quiescent position. The turntable on the vessel can include production, process and reinjection equipment which reduces the pressure of hydrocarbons so that an available fluid swivel which can rotate without limit about a vertical axis, can be used to transfer the resulting low-pressure and relatively clean hydrocarbons to further processing and storage equipment on the vessel deck.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. An offshore system for mooring a vessel and transferring cargo between the vessel and a pipe at the sea floor comprising:

a column having upper and lower end portions;

a column conduit with upper and lower ends which extends along most of the height of said column;

means for detachably connecting the upper end portion of the column and the upper end of the conduit to a vessel;

at least three flexible chain devices attached to the lower end portion of the column and extending in different directions therefrom and in loose catenary curves to the sea floor;

a flexible conduit with first and second ends, said flexible conduit extending in a loop between its ends, said second end connected to the lower end of said column conduit;

means for coupling the first end of said flexible conduit to said pipe at the sea floor, said coupling means holding a portion of said flexible conduit higher above the sea floor than said second end at least when the column has been detached from the vessel and has sunk;

a weight hanging from the lower end portion of the column to a depth below the bottom of the column, said column being buoyant but the buoyancy of the column being insufficient to support all of said chain devices and said weight, the weight limiting the depth of submersion of the column when it is detached from the vessel by the column falling only until the weight rests on the sea floor, to a depth at which the bottom of said loop of said flexible conduit lies above the sea floor.

2. The system described in claim 1 wherein:

said column has a height greater than half the height of the sea, and the upper end of said column is pivotally connected to said vessel so the column can tilt about horizontal axes relative to the vessel, whereby the column acts like a long pendulum that gently urges a drifting vessel back to its initial position.

3. An offshore system comprising:

a vessel;

a universal joint hanging from said vessel and having means for connecting to the top of a column, to permit the column to pivot about a pair of horizontal axes relative to the vessel;

a pair of line guides which closely surround lines extending therethrough, lying on opposite sides of the lower end of said joint;

a winch means on said vessel for pulling up lines;

a column having a lower end anchored by a plurality of chains extending in loose catenary curves to the sea floor, and having an upper end; and a pair of lines extending from said winch means and through said line guides to the upper end of said column, whereby to urge said joint into alignment with the top of the column as the column is being pulled up.

4. An offshore system for mooring a vessel and transferring cargo between the vessel and a pipe at the sea floor comprising:

a column having upper and lower end portions;

a column conduit with upper and lower ends which extends along most of the height of said column;

means for detachably connecting the upper end portion of the column and the upper end of the conduit to a vessel, including a universal joint having a lower portion with means for connecting to the upper end of said column;

a winch apparatus mounted on said vessel;

a pair of line guides mounted on the lower portion of said joint; and a pair of lines extendable from said winch apparatus through said line guides, and to the upper end of said column, whereby to tilt the joint so it is largely aligned with the column to easily connect to the connecting means;

at least three flexible chain devices attached to the lower end portion of the column and extending in different directions therefrom and in loose catenary curves to the sea floor;

a flexible conduit with first and second ends, said flexible conduit extending in a loop between its ends, said second end connected to the lower end of said column conduit;

means for coupling the first end of said flexible conduit to said pipe at the sea floor, said coupling means holding a portion of said flexible conduit higher above the sea floor than said second end at least when the column has been detached from the vessel and has sunk;

a weight hanging from the lower end portion of the column to a depth below the bottom of the column, said column being buoyant but the buoyancy of the column being insufficient to support all of said chain devices and said weight, the weight limiting the depth of submersion of the column when it is detached from the vessel by the column falling only until the weight rests on the sea floor, to a depth at which the bottom of said loop of said flexible conduit lies above the sea floor.

5. In a vessel which has a hull, a platform rotatably mounted on the hull about a vertical axis, and a winch means for pulling up lines extending from an underwater column whose upper end can move vertically and horizontally, and wherein the column upper end has a connector for connection to the platform after the column has been raised, the improvement comprising:

a two axis joint mounted at the bottom of said platform said joint having a connector which can connect to the column connector and which can pivot about two horizontal axes relative to the platform, said joint having a pair of upper line guides and a pair of lower line guides, the line guides of a pair lying at substantially the same height, for receiving said lines that extend between said column and said winch means each line guide closely surrounding a line passing therethrough;

said upper line guides lying at about the same height as said axes of said joint, said joint having a lower portion, and said lower guides lie at the lower portion of the joint;

said winch means is constructed to pull up two lines, each extending through one lower and one upper guide.

6. The improvement described in claim 5 including:

a third guide lying on said platform above said two axis joint but below said winch means, for receiving said line.

7. The improvement described in claim 5 wherein:

each of said guides has a lower portion which has a width that increases at progressively lower locations along the guide.

* * * * *